US009052629B2

(12) United States Patent
Watanabe et al.

(10) Patent No.: US 9,052,629 B2
(45) Date of Patent: Jun. 9, 2015

(54) IMAGE FORMING APPARATUS

(75) Inventors: Kazuhiko Watanabe, Tokyo (JP); Keiji Okamoto, Kanagawa (JP)

(73) Assignee: Ricoh Company. Ltd., Tokyo (JP)

( * ) Notice: Subject to any disclaimer, the term of this patent is extended or adjusted under 35 U.S.C. 154(b) by 22 days.

(21) Appl. No.: 13/599,921

(22) Filed: Aug. 30, 2012

(65) Prior Publication Data

US 2013/0071163 A1 Mar. 21, 2013

(30) Foreign Application Priority Data

Sep. 19, 2011 (JP) ..... 2011-203987

(51) Int. Cl.
*G03G 21/00* (2006.01)
*G03G 15/01* (2006.01)
*G03G 15/02* (2006.01)

(52) U.S. Cl.
CPC ..... *G03G 15/0189* (2013.01); *G03G 21/00* (2013.01); *G03G 21/0094* (2013.01); *G03G 21/0035* (2013.01); *G03G 21/0005* (2013.01); *G03G 21/0011* (2013.01); *G03G 15/0208* (2013.01); *G03G 2215/0132* (2013.01)

(58) Field of Classification Search
CPC ..... G03G 21/00
USPC ..... 399/346
See application file for complete search history.

(56) References Cited

U.S. PATENT DOCUMENTS 7,693,475 B2 * 4/2010 Shakuto et al. ..... 399/346
7,929,875 B2 * 4/2011 Nishida ..... 399/48
8,219,017 B2 * 7/2012 Nakai et al. ..... 399/346
8,369,769 B2 * 2/2013 Ohmori et al. ..... 399/350
2006/0210334 A1 * 9/2006 Tokumasu et al. ..... 399/346
2007/0258743 A1 * 11/2007 Shakuto et al. ..... 399/346
2008/0069615 A1 3/2008 Shintani et al.
2008/0112742 A1 5/2008 Nakamori et al.
2008/0260438 A1 10/2008 Uda et al.

(Continued)

FOREIGN PATENT DOCUMENTS

JP 2001-051467 * 2/2001 ..... G03G 15/02
JP 2001051467 * 2/2001 ..... G03G 15/01

(Continued)

OTHER PUBLICATIONS

Office Action for corresponding Chinese Application No. 201210350331.9 dated Dec. 15, 2014.

*Primary Examiner* — Clayton E Laballe
*Assistant Examiner* — Kevin Butler
(74) *Attorney, Agent, or Firm* — Harness, Dickey & Pierce

(57) ABSTRACT

An image forming apparatus forms a color image, and includes an endless intermediate transfer belt which rotates and carries a toner image and plural image forming units for plural colors arranged in tandem along the intermediate transfer belt. Each of the image forming units includes an image carrier which rotates and carries a latent image, a charging device which charges the image carrier, a development device which develops the latent image into a toner image, and a cleaning device which cleans the image carrier after the toner image is transferred to the intermediate transfer belt. The charging device of the extreme upstream image forming unit in the belt direction of rotation is a non-contact charging device not in contact with the image carrier. The extreme downstream image forming unit in the belt direction or rotation includes a lubricant application device which applies a lubricant to the image carrier.

20 Claims, 3 Drawing Sheets

(56) References Cited

U.S. PATENT DOCUMENTS

| | | | | |
|---|---|---|---|---|
| 2009/0003858 | A1* | 1/2009 | Nishida | 399/48 |
| 2009/0010693 | A1 | 1/2009 | Hatori et al. | |
| 2011/0052286 | A1* | 3/2011 | Urayama et al. | 399/346 |
| 2011/0206431 | A1* | 8/2011 | Tawada et al. | 399/346 |
| 2011/0217102 | A1* | 9/2011 | Ohmori et al. | 399/350 |
| 2013/0071163 | A1* | 3/2013 | Watanabe et al. | 399/346 |
| 2013/0177329 | A1* | 7/2013 | Tanaka et al. | 399/66 |
| 2013/0259552 | A1* | 10/2013 | Hasegawa et al. | 399/346 |
| 2014/0093294 | A1* | 4/2014 | Komito et al. | 399/346 |

FOREIGN PATENT DOCUMENTS

| | | | |
|---|---|---|---|
| JP | 2004279734 | A | 10/2004 |
| JP | 2008-076498 | | 4/2008 |

* cited by examiner

IMAGE FORMING APPARATUS

CROSS-REFERENCE TO RELATED APPLICATION

This patent application is based on and claims priority pursuant to 35 U.S.C. §119 to Japanese Patent Application No. 2011-203987, filed on Sep. 19, 2011, in the Japan Patent Office, the entire disclosure of which is hereby incorporated by reference herein.

BACKGROUND OF THE INVENTION

1. Field of the Invention

The present invention relates to a tandem-type image forming apparatus including a plurality of image forming units and an intermediate transfer belt.

2. Description of the Related Art

An electrophotographic image forming unit used in a currently widely used image forming apparatus, such as a copier and a printer, includes a multitude of components, such as a photoconductor serving as an image carrier, a charging device, a development device, a cleaning blade forming a cleaning device, and a lubricant application device for extending the life of the photoconductor and ensuring the cleaning performance. The lubricant application device includes, for example, a solid lubricant, a lubricant application brush, and an applicator blade for uniformly applying the lubricant. Further, a tandem-type color image forming apparatus is widely used which includes a plurality of image forming units for a plurality of colors and an intermediate transfer belt.

In recent years, along with the spread of color image forming apparatuses, demand for a reduction in cost and size of the image forming units has only increased. To reduce the cost and size of the image forming units, it is effective to simply configure each of the image forming units to include only a photoconductor, a charging device, a development device, and a cleaning device, with omission of the lubricant application device.

Further, in an environment in which the image forming apparatus is commonly used, such as an office, the number of outputs of monochrome images is usually larger than the number of outputs of color images. That is, in the image forming apparatus used in an environment such as an office, a black image forming unit for the black color is usually used more often and therefore has a shorter lifespan than that of color image forming units for yellow, cyan, and magenta. This is because the photoconductor in the black image forming unit for the black color is operated more frequently and thus longer than the photoconductors in the color image forming units for the yellow, cyan, and magenta, and thus the photoconductor for the color black is abraded faster in the black image forming unit than in the color image forming units.

To address the faster abrasion and consequent shorter lifespan of the photoconductor in the black image forming unit than in the color image forming units, various proposals have been made. For example, in one approach involving a direct-transfer tandem-type image forming apparatus including a plurality of photoconductors and capable of forming a color image, a black image forming unit provided on the extreme downstream side in the direction of rotation of a transfer feed belt includes a charging device (i.e., charger) configured as a non-contact corotron charger, with each of the color image forming units including a charging device configured as a contact-type charging roller (i.e., charging roll).

With this configuration of the image forming units, the abrasion of the photoconductor due to friction between the photoconductor and the charging roller in contact therewith is minimized and the lifespan of the photoconductor for the black color is made to last longer than in a configuration in which the charging devices for the respective colors are all configured as contact-type charging rollers.

Further, the application of a lubricant to a photoconductor is known to extend the life of the photoconductor. Therefore, providing a lubricant application device to the black image forming unit is also effective in extending the life of the black image forming unit. That is, the application of a lubricant to the photoconductor for the black color reduces the abrasion of the photoconductor for the black color, and consequently extends the life of the black image forming unit.

In addition, in recent years, an intermediate transfer method using an intermediate transfer belt has been commonly employed in tandem-type color image forming apparatuses. The black image forming unit is typically provided on the extreme downstream side in the direction of rotation of the intermediate transfer belt for such reasons as reducing the time taken for the first print. In this case, however, the lubricant applied to the photoconductor for the black color is affected and degraded by the charging device, and a part of the degraded lubricant is transferred from the photoconductor onto the intermediate transfer belt in a primary transfer section of the black image forming unit. Thereafter, in a primary transfer section of the image forming unit located on the extreme upstream side in the moving direction of the intermediate transfer belt, a part of the lubricant transferred to the intermediate transfer belt is transferred onto the photoconductor of the extreme upstream image forming unit.

If the charging device of the extreme upstream image forming unit is a contact-type charging roller, as in the above-described background image forming apparatus, the lubricant tends to adhere to the charging roller via the photoconductor and contaminate the charging roller. If the degraded lubricant thus adheres to and contaminates the charging roller, the photoconductor of the extreme upstream image forming unit may fail to be favorably and uniformly charged, and such a failure may result in the generation of an abnormal image.

SUMMARY OF THE INVENTION

The present invention describes a novel image forming apparatus. In one example, a novel image forming apparatus forms a color image, and includes an endless intermediate transfer belt configured to rotate and carry a toner image thereon, and a plurality of image forming units for a plurality of colors arranged in tandem along the intermediate transfer belt. Each of the image forming units includes an image carrier which rotates and carries a latent image, a charging device which charges the image carrier to form the latent image, a development device which develops the latent image into a toner image, and a cleaning device which cleans the image carrier after the toner image is transferred to the intermediate transfer belt. The charging device is configured as a non-contact charging device not in contact with the image carrier in an extreme upstream one of the image forming units in the direction of rotation of the intermediate transfer belt. An extreme downstream one of the image forming units in the direction of rotation of the intermediate transfer belt further includes a lubricant application device configured to apply a lubricant to the image carrier.

The above-described image forming apparatus may further include a lubricant amount detector that detects an amount of lubricant present on the intermediate transfer belt, and a lubricant amount adjustment mechanism that adjusts the amount of lubricant applied by the lubricant application device in the extreme downstream image forming unit in accordance with the amount of lubricant detected on the intermediate transfer belt by the lubricant amount detector.

The above-described image forming apparatus may further include a belt cleaning blade configured to clean the intermediate transfer belt. The lubricant amount detector may detect the amount of lubricant present on the intermediate transfer belt by detecting a change in frictional force acting between the intermediate transfer belt and the belt cleaning blade.

The lubricant application device may include an application member configured to apply the lubricant to the image carrier, and the lubricant amount adjustment mechanism may adjust a rotation rate of the application member to adjust the amount of lubricant applied by the lubricant application device in the extreme downstream image forming unit.

The lubricant may be a stick-shaped solid lubricant, and the lubricant amount adjustment mechanism may adjust an amount of indentation of the application member into the stick-shaped solid lubricant to adjust the amount of lubricant applied by the lubricant application device in the extreme downstream image forming unit.

The lubricant amount detector may include a torque detection device that detects changes in drive torque of the intermediate transfer belt.

The lubricant amount detector may include a deformation amount detection device provided to the belt cleaning blade that measures changes in elastic deformation of the belt cleaning blade.

The lubricant amount detector may be a strain sensor.

The charging device of the extreme downstream image forming unit may be a non-contact charging device not in contact with the image carrier.

The extreme downstream image forming unit may store black toner.

The lubricant may include zinc stearate.

The lubricant may include zinc stearate and boron nitride.

The cleaning device provided in each of the image forming units may include a cleaning blade having an edge layer in contact with the image carrier, and the edge layer is made of a material having a 100% modulus value ranging from approximately 6 megapascals to approximately 12 megapascals at a temperature of 23 degrees Celsius.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
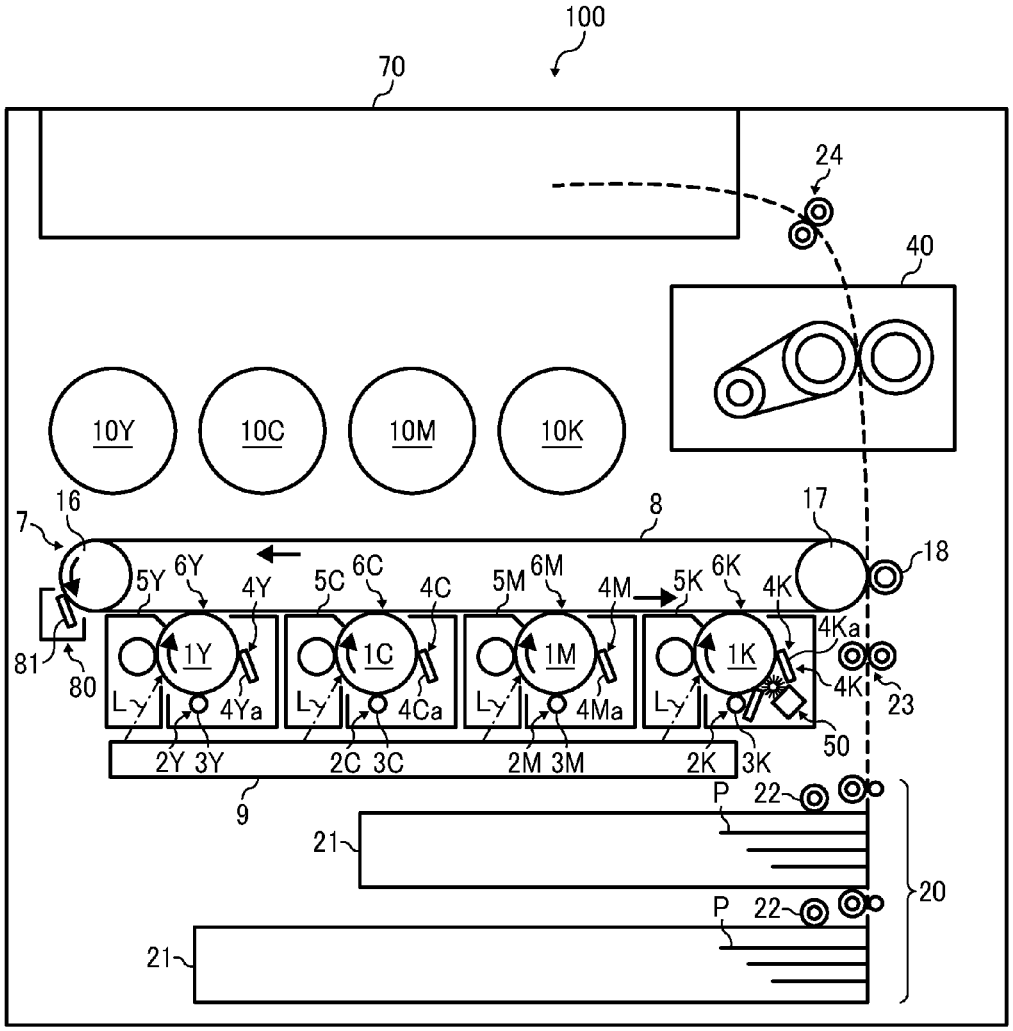
FIG. 1 is an overall schematic diagram of a printer according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieves a similar result.

Referring now to the drawings, wherein like reference numerals designate identical or corresponding parts throughout the several views, a so-called intermediate-transfer tandem-type color printer 100 (hereinafter simply referred to as the printer 100) will be described as an image forming apparatus according to an embodiment of the present invention. A basic configuration of the printer 100 will be first described.

As illustrated in FIG. 1, the printer 100 according to the present embodiment includes an image forming section including an intermediate transfer unit 7 and four process cartridges 6Y, 6C, 6M, and 6K. The intermediate transfer unit 7 includes an endless loop-shaped intermediate transfer belt 8. The process cartridges 6Y, 6C, 6M, and 6K serve as image forming units for sequentially forming respective toner images of yellow, cyan, magenta, and black colors (hereinafter referred to as the colors Y, C, M, and K, respectively) from the extreme upstream side in the direction of rotation of the intermediate transfer belt 8 (hereinafter simply referred to as the extreme upstream side). The four process cartridges 6Y, 6C, 6M, and 6K include photoconductors 1Y, 1C, 1M, and 1K, respectively, which are drum-shaped latent image carriers. The photoconductors 1Y, 1C, 1M, and 1K are respectively surrounded by, for example, charging devices 2Y, 2C, 2M, and 2K, development devices 5Y, 5C, 5M, and 5K, drum cleaning devices 4Y, 4C, 4M, and 4K, and not-illustrated discharging devices. The charging devices 2Y, 2C, 2M, and 2K respectively include charging rollers 3Y, 3C, 3M, and 3K serving as charging members. The drum cleaning devices 4Y, 4C, 4M, and 4K serve as photoconductor cleaning devices, and mainly include drum cleaning blades 4Ya, 4Ca, 4Ma, and 4Ka , respectively. It should be noted that the order of arrangement of the image forming units for the Y, C, and M colors, excluding the black image forming unit provided on the extreme downstream side in the direction of rotation of the intermediate transfer belt 8 (hereinafter simply referred to as the extreme downstream side), is not limited to the above-described order. The above-described order of arrangement of the image forming units for the Y, C, and M colors is only an example.

As described in detail later, the process cartridge 6K serving as the black image forming unit is provided with a lubricant application mechanism 50 as a lubricant application device for reducing the amount of abrasion of the photoconductor 1K and extending the life of the photoconductor 1K. By contrast, the process cartridges 6Y, 6C, and 6M serving as color image forming units are not provided with a lubricant application device. Otherwise, the process cartridges 6Y, 6C, and 6M are basically similar in configuration, except for the difference in color of toners used therein (i.e., Y, C, and M colors). The process cartridge 6K is also similar in configuration to the process cartridges 6Y, 6C, and 6M, except for the use of a K color toner and the presence of the lubricant application mechanism 50.

The intermediate transfer unit 7 including the intermediate transfer belt 8 is disposed above the process cartridges 6Y, 6C, 6M, and 6K. In addition to the intermediate transfer belt 8, the intermediate transfer unit 7 includes, for example, four not-illustrated primary transfer rollers disposed inside the loop of the intermediate transfer belt 8, a drive roller 16 also serving as a cleaning opposite roller, a secondary transfer opposite roller 17, a secondary transfer roller 18 disposed outside the loop of the intermediate transfer belt 8, and a belt cleaning device 80. The intermediate transfer belt 8 is rotated in the counterclockwise direction in FIG. 1 in accordance with the rotation of the secondary transfer opposite roller 17, which also serves as a drive roller driven to rotate in the counterclockwise direction in FIG. 1 by a not-illustrated drive device.

The intermediate transfer belt 8 is sandwiched between the four not-illustrated primary transfer rollers disposed inside the loop of the intermediate transfer belt 8 and the photoconductors 1Y, 1C, 1M, and 1K. Accordingly, primary transfer areas for the Y, C, M, and K colors are formed in which the outer circumferential surface of the intermediate transfer belt 8 and the respective photoconductors 1Y, 1C, 1M, and 1K are in contact with each other. A primary transfer bias with a voltage opposite in polarity to the toners is applied to each of the primary transfer rollers by a not-illustrated power supply.

The intermediate transfer belt 8 is further sandwiched between the secondary transfer opposite roller 17 disposed inside the loop of the intermediate transfer belt 8 and the secondary transfer roller 18 disposed outside the loop of the intermediate transfer belt 8. Accordingly, a secondary transfer area is formed in which the outer circumferential surface of the intermediate transfer belt 8 and the secondary transfer roller 18 are in contact with each other. A secondary transfer bias with a voltage opposite in polarity to the toners is applied to the secondary transfer roller 18 by a not-illustrated power supply. The above-described configuration may be modified such that a sheet feed belt is wound around the secondary transfer roller 18, a plurality of support rollers, and a drive roller, and that the sheet feed belt and the intermediate transfer belt 8 are sandwiched between the secondary transfer roller 18 and the secondary transfer opposite roller 17.

The intermediate transfer belt 8 is further sandwiched between the drive roller 16, which also serves as a cleaning opposite roller disposed inside the loop of the intermediate transfer belt 8, and a belt cleaning blade 81 included in the belt cleaning device 80. With the drive roller 16 and the belt cleaning blade 81 thus sandwiching the intermediate transfer belt 8, a belt cleaning area is formed.

Below the process cartridges 6Y, 6C, 6M, and 6K, an optical writing unit 9 is provided which irradiates the respective outer circumferential surfaces of the photoconductors 1Y, 1C, 1M, and 1K with laser light L to write thereon respective electrostatic latent images. On the basis of image data transmitted from, for example, a personal computer, the optical writing unit 9 forms the electrostatic latent images on the photoconductors 1Y, 1C, 1M, and 1K.

Above the intermediate transfer unit 7, toner bottles 10Y, 10C, 10M, and 10K are provided which store the toners of the respective colors for refilling the development devices 5Y, 5C, 5M, and 5K of the process cartridges 6Y, 6C, 6M, and 6K via not-illustrated refilling devices. Below the optical writing unit 9, a sheet feeding unit 20 is provided which includes sheet feeding cassettes 21 for storing recording sheets P each serving as a recording medium and sheet feeding rollers 22 for feeding the recording sheets P to a sheet feed path inside the printer 100 from the sheet feeding cassettes 21. Below the above-described secondary transfer area in FIG. 1, a registration roller pair 23 is provided which receives the recording sheet P fed from of the sheet feeding unit 20, and feeds the recording sheet P toward the secondary transfer area with predetermined timing. Above the secondary transfer area in FIG. 1, a fixing device 40 is provided which receives the recording sheet P fed from the secondary transfer area, and performs a toner image fixing process on the recording sheet P. On the downstream side of the fixing device 40 in the feeding direction of the recording sheet P, sheet discharging rollers 24 and a discharged sheet storing unit 70 for storing the discharged recording sheet P are provided.

Application of the lubricant in the intermediate transfer unit 7 and the process cartridges 6Y, 6C, 6M, and 6K included in the image forming section will now be described.

Figure 2:
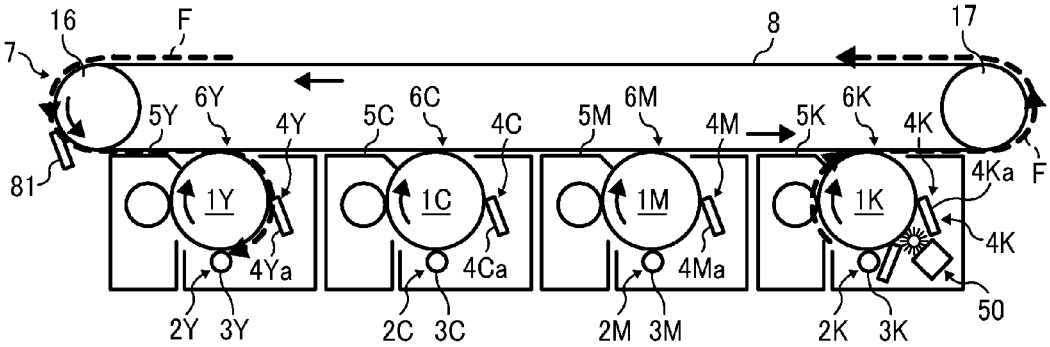
FIG. 2 is a diagram illustrating a flow of transfer of a lubricant in an image forming section of the printer.

As illustrated in FIG. 2, the process cartridge 6K serving as the black image forming unit is provided with the lubricant application mechanism 50 to reduce the amount of abrasion of the photoconductor 1K and extend the life of the photoconductor 1K. Meanwhile, the process cartridges 6Y, 6C, and 6M serving as the color image forming units are not provided with a lubricant application mechanism.

As indicated by arrows F in FIG. 2, the lubricant applied to the photoconductor 1K of the process cartridge 6K disposed on the extreme downstream side is transferred, via the intermediate transfer belt 8, onto the photoconductor 1Y of the process cartridge 6Y for the Y color disposed on the extreme upstream side. The transferred lubricant is decomposed into fine molecules and degraded by the charging device 2Y of the process cartridge 6Y. If the degraded lubricant adheres to the charging roller 3Y serving as the charging member of the charging device 2Y, an abnormal image is generated. Particularly when the charging device 2Y employs a contact roller charging system, which is one of contact charging systems, the degraded lubricant tends to adhere to the outer circumferential surface of the charging roller 3Y serving as the charging member. As a result, the degraded lubricant causes a local change in resistance value, and manifests as an abnormal image, such as an image with a black or white streak.

Therefore, in the present embodiment, to prevent production of such an abnormal image, the process cartridge 6Y disposed on the extreme upstream side employs a non-contact roller charging system. With the use of the non-contact roller charging system as the charging system of the charging device 2Y, the lubricant is less likely to adhere to the charging roller 3Y configured as a non-contact charging roller than in a configuration using the contact roller charging system. The present configuration therefore minimizes the generation of the above-described abnormal image.

Moreover, as described above, the process cartridge 6Y disposed on the extreme upstream side does not include a lubricant application mechanism. Therefore, the lubricant that may adhere to the charging roller 3Y of the charging device 2Y is limited to the lubricant which is transferred to the process cartridge 6Y via the intermediate transfer belt 8. Further, the non-contact roller charging system in which the charging device 2Y is not in contact with the photoconductor 1Y is employed as the charging system of the charging device 2Y of the process cartridge 6Y on the extreme upstream side. As a result, the adhesion to the charging roller 3Y of the degraded lubricant transferred from the intermediate transfer belt 8 is suppressed, and thus the generation of an abnormal image attributed to the adhesion of the degraded lubricant to the charging roller 3Y is suppressed. On the other hand, the process cartridge 6K on the extreme downstream side includes the lubricant application mechanism 50 for applying the lubricant to the photoconductor 1K, and thus the life of the photoconductor 1K is extended. Accordingly, the printer 100 suppresses the generation of an abnormal image attributed to the adhesion of the degraded lubricant to the charging roller 3Y of the charging device 2Y provided in the process cartridge 6Y on the extreme upstream side while simultaneously extending the life of the photoconductor 1K of the process cartridge 6K serving as the relatively frequently used black image forming unit.

As described above, the lubricant is applied in the process cartridge 6K on the extreme downstream side having the lubricant application mechanism 50, and reaches and is transferred to the process cartridge 6Y on the extreme upstream side via the intermediate transfer belt 8. The amount of lubricant applied in the process cartridge 6K and transferred to the process cartridge 6Y varies depending on the output image pattern. If a sequence of image patterns with a relatively large toner adhesion amount is output, the lubricant is transferred to the recording sheets P together with the toners. Therefore, the amount of lubricant staying on the intermediate transfer belt 8 and transferred to the process cartridge 6Y is reduced. Meanwhile, if a sequence of image patterns with a relatively small toner adhesion amount is output, the amount of lubricant transferred to the recording sheets P together with the toners is reduced. Therefore, the amount of lubricant staying on the intermediate transfer belt 8 and transferred to the process cartridge 6Y is increased. In this case, the amount of lubricant reaching the process cartridge 6Y on the extreme upstream side via the intermediate transfer belt 8 is increased, and the charging roller 3Y of the charging device 2Y according to the non-contact roller charging system tends to be contaminated.

In the charging device 2Y according to the non-contact roller charging system provided in the process cartridge 6Y on the extreme upstream side, the charging roller 3Y tends to be contaminated because the gap between a photoconductor and a non-contact charging roller used in the non-contact roller charging system is approximately 100 μm or less. If a relatively large amount of lubricant is transferred from an intermediate transfer belt to the photoconductor, therefore, the lubricant tends to adhere to the non-contact charging roller. Further, while there is demand for the extension of the life of the image forming unit, the accumulation of the degraded lubricant adhering to the non-contact charging roller may cause an abnormal image, and thus even the use of the non-contact roller charging system may fail to sufficiently suppress the generation of an abnormal image although it might extend the life of the image forming unit. In practical terms, this means that, in substance, the use life of the process cartridge 6Y on the extreme upstream side may fail to be extended. It is therefore desirable to make the degraded lubricant less likely to adhere to the charging roller 3Y of the charging device 2 in the process cartridge 6Y on the extreme upstream side by configuring the charging roller 3 as a non-contact charging roller, and to reduce, as much as possible, the amount of lubricant that may adhere to the charging roller 3Y by reducing the amount of lubricant transferred from the intermediate transfer belt 8 to the photoconductor 1Y of the process cartridge 6Y on the extreme upstream side.

In view of the above, the present embodiment adjusts, in accordance with the amount of lubricant present on the intermediate transfer belt 8, the amount of lubricant applied by the lubricant application mechanism 50 of the process cartridge 6K provided on the extreme downstream side. Particularly when the amount of lubricant present on the intermediate transfer belt 8 is relatively large, the amount of lubricant applied by the lubricant application mechanism 50 in the process cartridge 6K is reduced. With this configuration which reduces the amount of lubricant transferred to the photoconductor 1Y of the process cartridge 6Y on the extreme upstream side, the amount of lubricant that may reach and adhere to the charging roller 3Y of the process cartridge 6Y on the extreme upstream side is reduced to an appropriate amount. Accordingly, the contamination of the charging roller 3Y is effectively suppressed.

Consequently, the life of the process cartridge 6Y on the extreme upstream side is extended with no adverse effect on the process cartridges 6C and 6M serving as the other color image forming units. Further, the printer 100 applies the lubricant to the photoconductor 1K of the process cartridge 6K, and thus the life of the process cartridge 6K on the extreme downstream side is also extended.

A description will now be given of a configuration which adjusts, in accordance with the amount of lubricant present on the intermediate transfer belt 8, the amount of lubricant applied by the lubricant application mechanism 50 in the process cartridge 6K provided on the extreme downstream side, and thereby reduces the amount of lubricant transferred from the intermediate transfer belt 8 to the process cartridge 6Y on the extreme upstream side.

Figure 3:
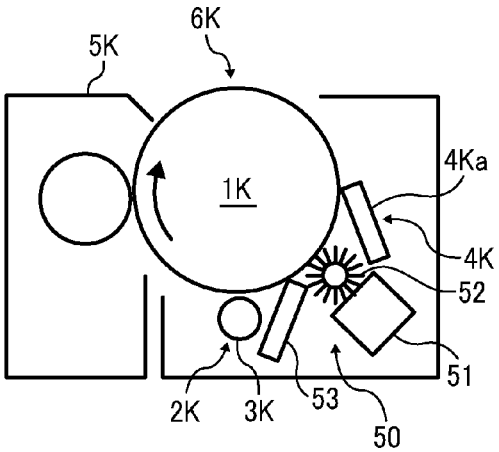
FIG. 3 is a diagram illustrating a black image forming unit of the image forming section.
Figure 4:
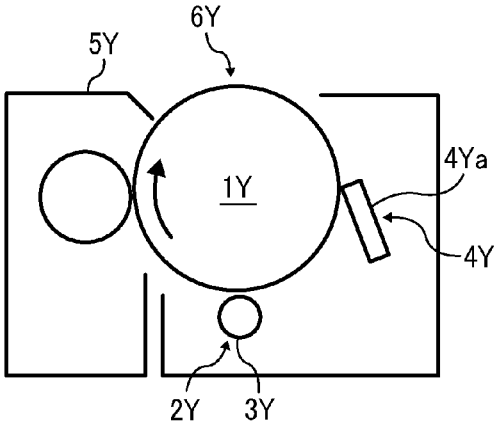
FIG. 4 is a diagram illustrating a color image forming unit of the image forming section.

As illustrated in FIG. 3, the process cartridge 6K on the extreme downstream side serving as the black image forming unit mainly includes the drum cleaning device 4K including the drum cleaning blade 4Ka , the charging device 2K including the charging roller 3K, which is an alternating current (AC) voltage-superimposed non-contact charging roller, the photoconductor 1K, the development device 5K, and the lubricant application mechanism 50 including a stick-shaped solid lubricant 51, an application brush 52, and an applicator blade 53. The charging roller 3K of the charging device 2K is configured as a non-contact charging roller. Therefore, the printer 100 suppresses the contamination of the charging roller 3K and reduces the amount of abrasion of the photoconductor 1K, to thereby extend the life of the process cartridge 6K. Meanwhile, as illustrated in FIG. 4, the process cartridge 6Y serving as the image forming unit on the extreme upstream side mainly includes the drum cleaning device 4Y including the drum cleaning blade 4Ya, the charging device 2Y including the charging roller 3Y, which is an AC voltage-superimposed non-contact charging roller, the photoconductor 1Y, and the development device 5Y. That is, the process cartridge 6Y does not include the lubricant application mechanism 50 formed by the stick-shaped solid lubricant 51, the application brush 52, and the applicator blade 53. Further, as described above, the process cartridges 6C and 6M serving as the other color image forming units are basically similar in configuration to the process cartridge 6Y, but are not necessarily required to use non-contact charging rollers as the charging rollers 3C and 3M, respectively. To reduce the contamination of the charging rollers 3C and 3M and the amount of abrasion of the photoconductors 1C and 1M, however, it is preferable to configure the charging rollers 3C and 3M as non-contact charging rollers.

In the process cartridge 6K illustrated in FIG. 3, which serves as the black image forming unit, the lubricant application mechanism 50 provided therein applies the lubricant to the outer circumferential surface of the photoconductor 1K to reduce the amount of abrasion of the photoconductor 1K and thereby extend the life of the photoconductor 1K. The arrows F in FIG. 2 illustrate the flow of transfer of the lubricant applied by the lubricant application mechanism 50 in the process cartridge 6K and transferred to the process cartridge 6Y on the extreme upstream side via the intermediate transfer belt 8. A part of the lubricant applied to the photoconductor 1K in the process cartridge 6K disposed on the extreme downstream side is transferred onto the photoconductor 1Y of the process cartridge 6Y on the extreme upstream side via the intermediate transfer belt 8. The transferred lubricant is decomposed into fine molecules and degraded by the AC voltage-superimposed charging roller 3Y of the charging device 2Y in the process cartridge 6Y. The charging device 2Y of the process cartridge 6Y on the extreme upstream side uses the charging roller 3Y configured as a non-contact charging roller. Therefore, the degraded lubricant is unlikely to adhere to the charging roller 3Y and manifest as an abnormal image.

Further, in addition to the above-described use of a non-contact charging roller as the charging roller 3Y of the charging device 2Y in the process cartridge 6Y, the amount of lubricant applied by the lubricant application mechanism 50 in the process cartridge 6K is reduced in accordance with the increase in the amount of lubricant present on the intermediate transfer belt 8 so as to reduce the amount of lubricant transferred to the charging roller 3Y of the process cartridge 6Y from the intermediate transfer belt 8. Accordingly, the contamination of the charging roller 3Y of the process cartridge 6Y is suppressed.

A description will now be given of a specific method of detecting the increase in the amount of lubricant present on the intermediate transfer belt 8, and adjusting the amount of lubricant applied by the lubricant application mechanism 50 in the process cartridge 6K on the basis of the detection result. The intermediate transfer unit 7 of the present embodiment does not include a mechanism which directly applies a lubricant to the intermediate transfer belt 8. Therefore, the amount of lubricant present on the intermediate transfer belt 8 in the process of transfer of the lubricant to the process cartridge 6Y corresponds to the amount of lubricant transferred from the process cartridge 6K to the intermediate transfer belt 8, staying on the intermediate transfer belt 8, and then transferred to the process cartridge 6Y, without being transferred to the recording sheet P together with the toners in the secondary transfer process or being cleaned off together with the toners in the belt cleaning process. This lubricant amount will be hereinafter referred to as the transferred lubricant amount.

In accordance with the amount of lubricant present on the intermediate transfer belt 8, i.e., in accordance with the increase or reduction of the transferred lubricant amount on the intermediate transfer belt 8, the coefficient of friction of the outer circumferential surface of the intermediate transfer belt 8 changes, and therefore the coefficient of friction between the intermediate transfer belt 8 and a member in contact therewith is reduced or increased. When the change in the coefficient of friction according to the increase or reduction in the transferred lubricant amount on the intermediate transfer belt 8 is detected, and particularly when it is detected that the coefficient of friction is relatively low, and thus that the transferred lubricant amount on the intermediate transfer belt 8 is relatively large, the amount of the lubricant applied by the lubricant application mechanism 50 is adjusted by the following method to reduce the amount of lubricant transferred to the process cartridge 6Y serving as the image forming unit on the extreme upstream side.

Figure 5:
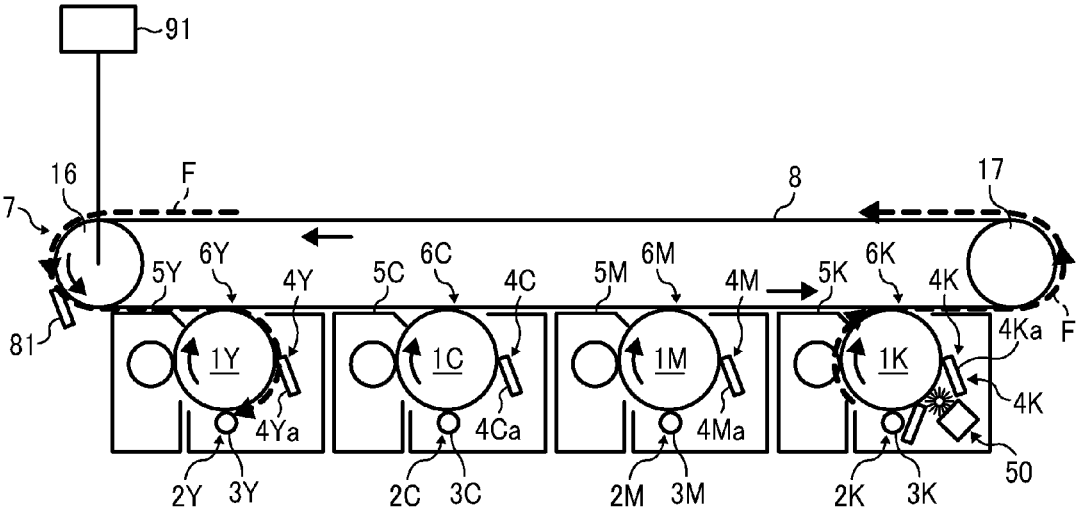
FIG. 5 is a diagram illustrating the detection of a change in coefficient of friction of an intermediate transfer belt in the image forming section based on the detection of drive torque of the intermediate transfer belt.

The detection of the increase or reduction in the transferred lubricant amount on the intermediate transfer belt 8 will be first described. For example, if the transferred lubricant amount on the intermediate transfer belt 8 is reduced, the coefficient of friction between the intermediate transfer belt 8 and the belt cleaning blade 81 is increased, and the drive torque of the intermediate transfer belt 8 is increased. Conversely, if the transferred lubricant amount on the intermediate transfer belt 8 is increased, the coefficient of friction between the intermediate transfer belt 8 and the belt cleaning blade 81 is reduced, and the drive torque of the intermediate transfer belt 8 is reduced. Therefore, a torque detection device 91 which detects the drive torque of the drive roller 16 is provided, as illustrated in FIG. 5, to detect a change in drive torque of the intermediate transfer belt 8, i.e., a change in frictional force. Thereby, the increase or reduction in the transferred lubricant amount on the intermediate transfer belt 8 is detected.

Figure 6:
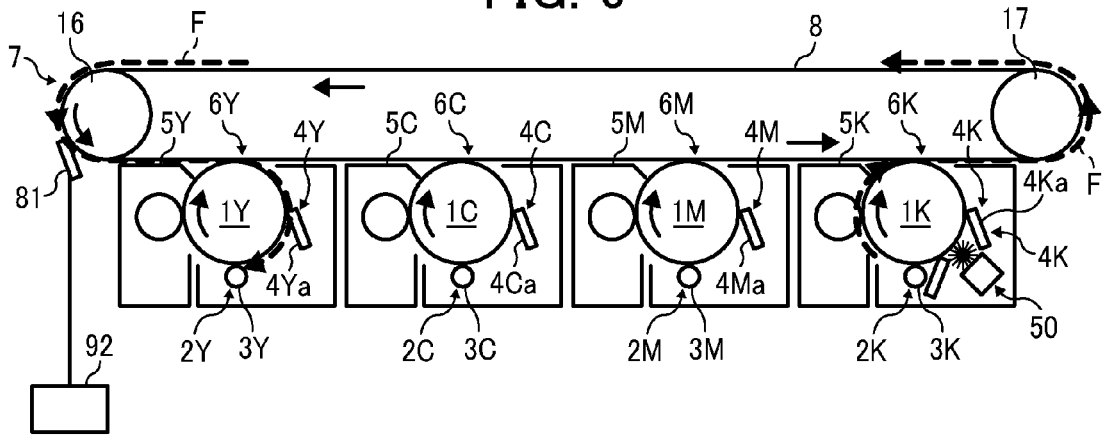
FIG. 6 is a diagram illustrating the detection of a change in coefficient of friction of the intermediate transfer belt in the image forming section based on the detection of the amount of elastic deformation of a belt cleaning blade for cleaning the intermediate transfer belt.

Further, the increase or reduction in the coefficient of friction between the intermediate transfer belt 8 and the belt cleaning blade 81 according to the reduction or increase in the transferred lubricant amount on the intermediate transfer belt 8 also manifests as a change in elastic deformation amount of the belt cleaning blade 81. Therefore, a deformation amount detection device 92, such as a strain sensor, is provided to the belt cleaning blade 81, as illustrated in FIG. 6, to measure the change in elastic deformation amount and detect the change in frictional force. Thereby, the increase or reduction in the transferred lubricant amount on the intermediate transfer belt 8 is detected. Then, in accordance with the detected increase or reduction in the transferred lubricant amount, the amount of lubricant transferred from the process cartridge 6K to the intermediate transfer belt 8 is adjusted. Particularly when it is detected that the amount of lubricant present on the intermediate transfer belt 8 is relatively large, and thus that the coefficient of friction between the intermediate transfer belt 8 and a member in contact therewith has been reduced, an adjustment is performed to reduce the amount of lubricant transferred from the process cartridge 6K to the intermediate transfer belt 8.

The change in the coefficient of friction between the intermediate transfer belt 8 and the belt cleaning blade 81 for the intermediate transfer belt 8 is detected by one of the above-described detection methods, and thereby the increase or reduction in the transferred lubricant amount on the intermediate transfer belt 8 is detected. Therefore, the printer 100 is capable of adjusting, in accordance with the increase or reduction in the transferred lubricant amount on the intermediate transfer belt 8, the amount of lubricant applied by the lubricant application mechanism 50 in the process cartridge 6K provided on the extreme downstream side, with relative ease and at relatively low cost without using a complicated device. That is, the printer 100 is capable of adjusting, in accordance with the amount of lubricant present on the intermediate transfer belt 8, the amount of the lubricant applied by the lubricant application mechanism 50 in the process cartridge 6K provided on the extreme downstream side.

A specific method of adjusting the lubricant application amount will now be described. If it is detected by one of the above-described detection methods that the transferred lubricant amount on the intermediate transfer belt 8 is relatively large, an operation of reducing the lubricant application amount in the process cartridge 6K is performed temporarily or for a predetermined time period for sufficiently reducing the transferred lubricant amount during the following image forming process, to thereby reduce the transferred lubricant amount on the intermediate transfer belt 8. A lubricant application method performed in the process cartridge 6K is normally based on the configuration as illustrated in FIG. 3. Specifically, the lubricant application mechanism 50 mainly including the application brush 52, the stick-shaped solid lubricant 51, and the applicator blade 53, which is provided downstream of the drum cleaning blade 4Ka in the rotation direction of the photoconductor 1K, is operated to reduce the amount of lubricant applied to the photoconductor 1K by charging the rotation rate of the application brush 52 or the amount of indentation of the application brush 52 into the stick-shaped solid lubricant 51.

Figure 7:
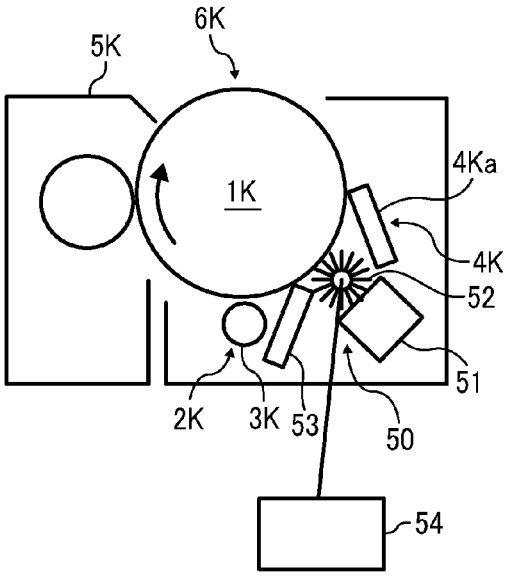
FIG. 7 is a diagram illustrating the adjustment of a lubricant application amount by adjustment of the rotation rate of an application brush.

The present embodiment, therefore, employs either one of the following adjustment methods. According to a first adjustment method, a rotation rate changing mechanism 54 which changes the rotation rate of the application brush 52 is provided, as illustrated in FIG. 7, to reduce the rotation rate of the application brush 52 for the predetermined time period and reduce the amount of lubricant applied to the photoconductor 1K. Thereby, the transferred lubricant amount on the intermediate transfer belt 8 is reduced. If the application brush 52 is singly driven to rotate, for example, the rotation rate changing mechanism 54 is capable of changing the rotation rate of the application brush 52 with relative ease by controlling the rotation rate of a not-illustrated drive motor. Provided with the rotation rate changing mechanism 54, the printer 100 is capable of adjusting, with relative ease and at relatively low cost, the amount of the lubricant applied to the photoconductor 1K.

Figure 8:
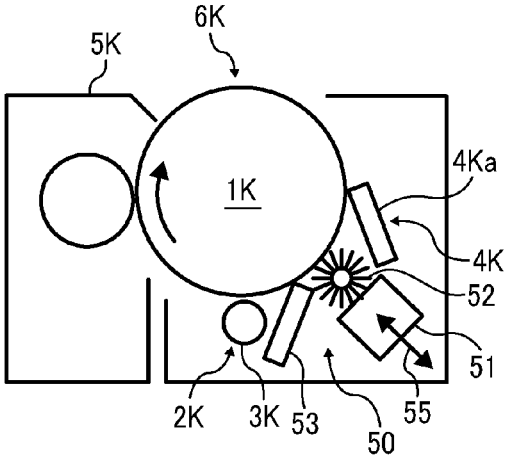
FIG. 8 is a diagram illustrating the adjustment of the lubricant application amount by adjustment of contact pressure of the application brush applied to a stick-shaped solid lubricant.

According to a second adjustment method, an indentation amount changing mechanism 55 which changes the amount of indentation of the application brush 52 into the stick-shaped solid lubricant 51 is provided, as illustrated in FIG. 8, to reduce the amount of indentation of the application brush 52 into the stick-shaped solid lubricant 51. Thereby, the transferred lubricant amount on the intermediate transfer belt 8 is reduced. For example, the indentation amount changing mechanism 55 may be formed by a relatively simple configuration in which a not-illustrated device for pressing the stick-shaped solid lubricant 51 against the application brush 52 has a support end portion moved back and forth along the pressing direction by a member such as a cam. Provided with the indentation amount changing mechanism 55, the printer 100 is capable of adjusting, with relative ease and at relatively low cost, the amount of lubricant applied to the photoconductor 1K, even if the application brush 52 is driven to rotate not singly but in conjunction with the rotational driving of another rotary member.

A description will now be given of a lubricant application method performed by the lubricant application mechanism 50. As illustrated in FIG. 3, in the lubricant application mechanism 50 of the process cartridge 6K, the application brush 52 and the applicator blade 53 are disposed along the outer circumferential surface of the photoconductor 1K toward the downstream side in the rotation direction of the photoconductor 1K such that the applicator blade 53 is located downstream of the application brush 52, and that the application brush 52 and the applicator blade 53 are disposed between the drum cleaning blade 4Ka located upstream thereof and the charging roller 3K located downstream thereof. Further, the stick-shaped solid lubricant 51 is provided at a position facing the photoconductor 1K via the application brush 52, and the application brush 52 is configured to scrape the stick-shaped solid lubricant 51 into powdered lubricant, while being indented into the stick-shaped solid lubricant 51 with a predetermined amount of indentation. If the above-described adjustment of the lubricant application amount is performed by the indentation amount changing mechanism 55, the indentation amount changing mechanism 55 moves, in accordance with the detected increase or reduction in the transferred lubricant amount, the stick-shaped solid lubricant 51 substantially parallel to a straight line passing the respective centers of rotation of the photoconductor 1K and the application brush 52 in FIG. 8.

In the lubricant application mechanism 50, the powdered lubricant scraped from the stick-shaped solid lubricant 51 by the application brush 52 is applied to the outer circumferential surface of the photoconductor 1K by the application brush 52. Then, the applicator blade 53 disposed downstream of the application brush 52 levels the lubricant applied to the outer circumferential surface of the photoconductor 1K, to thereby equalize the thickness of the lubricant. The present embodiment employs a counter contact method of bringing the applicator blade 53 into contact with the photoconductor 1K in the counter direction. However, a trailing contact method of bringing the applicator blade 53 into contact with the photoconductor 1K in the trailing direction is also applicable. Further, the leading end of the applicator blade 53 may be formed into an obtuse angle shape, which improves the lubricant application performance.

A description will now be given of the lubricant used in the present embodiment. The lubricant used in the present embodiment contains a hydrophobic organic compound (A), inorganic fine particles (B), and an inorganic lubricant (C). Examples of the hydrophobic organic compound (A) include: hydrocarbons grouped into aliphatic saturated hydrocarbon, aliphatic unsaturated hydrocarbon, alicyclic saturated hydrocarbon, alicyclic unsaturated hydrocarbon, and aromatic hydrocarbon; fluorine resins and fluorine waxes, such as polytetrafluoroethylene (PTFE), poly(perfluoroalkyl ether) (PFA), perfluoroethylene-perfluoropropylene copolymer (FEP), polyvinylidene fluoride (PVDF), and ethylene-tetrafluoroethylene copolymer (ETFE); and silicone resins and silicone waxes, such as polymethyl silicone and polymethyl phenyl silicone.

Further, typical fatty acids for extracting a fatty acid metal salt and a stable hydrophobic metal salt include caproic acid, caprylic acid, enanthylic acid, pelargonic acid, undecylic acid, lauric acid, tridecanoic acid, myristic acid, palmitic acid, margaric acid, stearic acid, nondecyclic acid, arachidic acid, behenic acid, stillingic acid, palmitoleic acid, oleic acid, ricinoleic acid, petroselinic acid, vaccenic acid, linoleic acid, linolenic acid, eleostearic acid, licanic acid, parinaric acid, gadoleic acid, arachidonic acid, cetoleic acid, and a mixture of two or more thereof. Typical stable metal salts of fatty acids include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate, and a mixture of two or more thereof.

The inorganic lubricant (C) refers to a substance which cleaves and lubricates itself or causes internal slip. Examples of the inorganic lubricant (C) include, but are not limited to, mica, boron nitride, molybdenum disulfide, tungsten disulfide, talc, kaolin, montmorillonite, calcium fluoride, and graphite. For example, in boron nitride, hexagonal lattice planes having firmly bonded atoms are layered at relatively wide intervals, and respective layers are bonded together only by weak Van der Waals force. Thus, the layers cleave with relative ease and lubrication occurs.

Meanwhile, the inorganic fine particles (B) refer to particles which enter a gap between substances and function as rollers but do not cause internal slip or cleavage therein. Examples of the inorganic fine particles (B) include, but are not limited to: metal oxides, such as silica, tin oxide, zinc oxide, titanium oxide, alumina, zirconium oxide, indium oxide, antimony oxide, bismuth oxide, calcium oxide, antimony-doped tin oxide, and tin-doped indium oxide; metal fluorides, such as tin fluoride, calcium fluoride, and aluminum fluoride; and potassium titanate. Further, two or more of the above-described substances may be used in combination.

In the stick-shaped solid lubricant 51 used in the present embodiment, zinc stearate, which is a fatty acid metal salt, as described above, is used as the hydrophobic organic compound (A), and alumina is used as the inorganic fine particles (B). Further, boron nitride is used as the inorganic lubricant (C). With the stick-shaped solid lubricant 51 thus containing at least zinc stearate, the printer 100 is improved in cleaning performance and transfer performance, and has an extended life. This is because zinc stearate having lamellar crystals has a layered structure with self-assembling amphiphilic molecules, in which the crystals applied with shearing force cleave and slide with relative ease along interlayer spaces. That is, zinc stearate has good lubricity. Further, with the stick-shaped solid lubricant 51 containing at least zinc stearate and boron nitride, the printer 100 maintains lubricity between the photoconductors 1Y, 1C, 1M, and 1K and the drum cleaning blades 4Ya, 4Ca, 4Ma, and 4Ka and between the intermediate transfer belt 8 and the belt cleaning blade 81 owing to the lubricity of boron nitride, even if the lubricant is affected by discharge occurring near the photoconductors 1Y, 1C, 1M, and 1K in the charging process performed by the charging devices 2Y, 2C, 2M, and 2K. Accordingly, the printer 100 suppresses the passage of toner particles through between the photoconductors 1Y, 1C, 1M, and 1K and the drum cleaning blades 4Ya, 4Ca, 4Ma, and 4Ka and between the intermediate transfer belt 8 and the belt cleaning blade 81.

Further, zinc stearate being a fatty acid metal salt used as the hydrophobic organic compound (A) is added with both alumina as the inorganic fine particles (B) and boron nitride as the inorganic lubricant (C). Accordingly, the cleaning performance of cleaning the photoconductors 1Y, 1C, 1M, and 1K and the intermediate transfer belt 8 is substantially improved, and the contamination of the members forming the charging devices 2Y, 2C, 2M, and 2K are substantially reduced. Further, filming, i.e., formation of a toner film, is prevented from occurring on the photoconductors 1Y, 1C, 1M, and 1K and the intermediate transfer belt 8. It is preferred that alumina used as the inorganic fine particles (B) has a particle diameter of less than approximately 3 μm, and that boron nitride used as the inorganic lubricant (C) has a mixing ratio of less than approximately 50%.

A description will now be given of the drum cleaning blades 4Ya, 4Ca, 4Ma, and 4Ka used in the present embodiment. The drum cleaning blades 4Ya, 4Ca, 4Ma, and 4Ka are similar in configuration, and thus will be collectively referred to as the drum cleaning blade 4*a* with omission of the alphabetical suffixes Y, C, M, and K, unless necessary, and a description thereof will be given with reference to FIG. 4. Similarly, the photoconductors 1Y, 1C, 1M, and 1K, the charging devices 2Y, 2C, 2M, and 2K, the development devices 5Y, 5C, 5M, and 5K, and the process cartridges 6Y, 6C, 6M, and 6K will be collectively referred to as the photoconductor 1, the charging device 2, the development device 5, and the process cartridge 6, respectively.

In the present embodiment, the drum cleaning blade 4*a* is configured as follows. The abrasion of the photoconductor 1 and the contamination of the outer circumferential surface of the photoconductor 1 due to an external additive added to the toner are more likely to occur in the process cartridges 6Y, 6C, and 6M serving as the color image forming units not performing the application of a lubricant than in the process cartridge 6K serving as the black image forming unit performing the application of a lubricant. The cleaning performance against the contamination of the outer circumferential surface of the photoconductor 1 is improved in accordance with the increase in the pressure with which an edge layer of the drum cleaning blade 4*a* contacts the photoconductor 1. Further, it is preferred that the edge layer is made of a urethane rubber having a 100% modulus value ranging from approximately 6 MPa (megapascals) to approximately 12 MPa at a temperature of 23 degrees Celsius. Further, if the drum cleaning blade 4*a* has a laminate structure including at least two layers including the edge layer in contact with the photoconductor 1 and a rear layer serving as a backup layer, and if the above-described contact pressure of the edge layer is set to be higher than the contact pressure of the rear layer, the drum cleaning blade 4*a* maintains favorable cleaning performance and a favorable effect against the contamination of the outer circumferential surface of the photoconductor 1 for a relatively long time. The edge layer and the backup layer are made of materials having different permanent set values. Further, the drum cleaning blade 4*a* is configured to have one fixed end held by a not-illustrated blade holder and the other free end forming an edge portion in contact with and cleaning the outer circumferential surface of the photoconductor 1 rotating clockwise in FIG. 4. The edge portion is included in the edge layer, which is made of a material higher in permanent set value than the material forming the backup layer.

In a typical existing blade member used to clean off a ground toner or a polymerized toner having relatively low sphericity and a particle diameter of approximately 6 μm or more, a single-layer rubber material having a 100% modulus value of approximately 5 MPa or less and a permanent set value of approximately 1.5% or less is used. Meanwhile, if a urethane rubber material having relatively high hardness and a relatively high 100% modulus value is used to form a blade member, the contact pressure of the blade against an image carrier such as a photoconductor is increased. Accordingly, the blade member is capable of cleaning off a polymerized toner having small-diameter spherical toner particles. In general, however, the urethane rubber material having a relatively high 100% modulus value tends to have a relatively high permanent set value. Therefore, if a material having a relatively high 100% modulus value is used in a blade member which has a typical free length of existing blade members and includes a single-layer urethane rubber material supported by a support plate made of a metal and serving as a holding member, so-called loss of elasticity tends to occur in the blade member. In some cases, therefore, the blade member fails to maintain the initial cleaning performance, and has difficulty in maintaining the cleaning performance for a relatively long time.

By contrast, in the drum cleaning blade 4*a* according to the present embodiment, a material having relatively high hardness and a relatively high 100% modulus value is used in the edge layer forming the edge portion in contact with the photoconductor 1 serving as a cleaning target object, in order to increase the contact pressure of the drum cleaning blade 4*a* in the contact area of the drum cleaning blade 4*a* in contact with the cleaning target object and thereby clean off a polymerized toner having small-diameter spherical toner particles. Preferably, the edge layer is made of a rubber material having a 100% modulus value ranging from approximately 6 MPa to approximately 12 MPa at a temperature of 23 degrees Celsius. Further, to prevent the loss of elasticity, which occurs in a blade member using a material having a relatively high 100% modulus value, the rear side of the edge layer not facing the photoconductor 1 is provided with the backup layer, which is made of a rubber material different in composition from the rubber material forming the edge layer. The backup layer uses a material lower in hardness, 100% modulus value, and permanent set value than the material forming the edge layer. With the use of the thus-configured drum cleaning blade 4*a*, the printer 100 is capable of increasing the contact pressure of the drum cleaning blade 4*a* in the contact area of the drum cleaning blade 4*a* in contact with the photoconductor 1 serving as the cleaning target object, and favorably cleaning off the polymerized toner having small-diameter spherical toner particles.

Further, in each of the image forming units for the respective colors according to the present embodiment described above, the constituent elements thereof, i.e., the photoconductor 1, the charging device 2, the drum cleaning blade 4*a*, the development device 5, and other components such as the discharging device (and the lubricant application mechanism 50 in the case of the black image forming unit) form one process cartridge 6. The present invention, however, is not limited to this configuration. For example, in each of the image forming units for the respective colors, the constituent elements excluding the development device 5 may be configured as one process cartridge 6, and the development device 5 may be configured separately therefrom.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus, comprising:

an endless intermediate transfer belt configured to rotate and carry a toner image thereon; and a plurality of image forming units for a plurality of colors arranged in tandem along the endless intermediate transfer belt, each of the plurality of image forming units including:

an image carrier configured to rotate and carry a latent image;

a charging device configured to charge the image carrier to form the latent image;

a development device configured to develop the latent image into a toner image; and a cleaning device configured to clean the image carrier after the toner image is transferred to the endless intermediate transfer belt, wherein the charging device is configured as a non-contact charging device not in contact with the image carrier in a farthest upstream one of the plurality of image forming units in the direction of rotation of the endless intermediate transfer belt, and a farthest downstream one of the plurality of image forming units in the direction of rotation of the endless intermediate transfer belt further includes a lubricant application device configured to apply a lubricant to the image carrier.

2. The image forming apparatus according to claim 1, further comprising:

a lubricant amount detector configured to detect an amount of lubricant present on the endless intermediate transfer belt; and a lubricant amount adjustment mechanism configured to adjust an amount of lubricant applied by the lubricant application device in the farthest downstream one of the plurality of image forming units in accordance with the amount of lubricant detected on the endless intermediate transfer belt by the lubricant amount detector.

3. The image forming apparatus according to claim 2, further comprising:

a belt cleaning blade configured to clean the endless intermediate transfer belt, wherein the lubricant amount detector detects the amount of lubricant present on the endless intermediate transfer belt by detecting a change in frictional force acting between the intermediate transfer belt and the belt cleaning blade.

4. The image forming apparatus according to claim 2, wherein the lubricant application device includes an application member configured to apply the lubricant to the image carrier, and the lubricant amount adjustment mechanism adjusts a rotation rate of the application member to adjust the amount of lubricant applied by the lubricant application device in the farthest downstream one of the plurality of image forming units.

5. The image forming apparatus according to claim 4, wherein the lubricant is a stick-shaped solid lubricant, and the lubricant amount adjustment mechanism adjusts an amount of indentation of the application member into the stick-shaped solid lubricant to adjust the amount of lubricant applied by the lubricant application device in the farthest downstream one of the plurality of image forming units.

6. The image forming apparatus according to claim 2, wherein the lubricant amount detector comprises a torque detection device configured to detect changes in drive torque of the intermediate transfer belt.

7. The image forming apparatus according to claim 2, wherein the lubricant amount detector comprises a deformation amount detection device provided to the belt cleaning blade, the lubricant amount detector being configured to measure changes in elastic deformation of the belt cleaning blade.

8. The image forming apparatus according to claim 7, wherein the lubricant amount detector is a strain sensor.

9. The image forming apparatus according to claim 1, wherein the charging device of the farthest downstream one of the plurality of image forming units is a non-contact charging device not in contact with the image carrier.

10. The image forming apparatus according to claim 1, wherein the farthest downstream one of the plurality of image forming units stores black toner.

11. The image forming apparatus according to claim 1, wherein the lubricant comprises zinc stearate.

12. The image forming apparatus according to claim 1, wherein the lubricant comprises zinc stearate and boron nitride.

13. The image forming apparatus according to claim 1, wherein the cleaning device provided in each of the plurality of image forming units includes a cleaning blade having an edge layer in contact with the image carrier, and the edge layer is made of a material having a 100% modulus value ranging from approximately 6 megapascals to approximately 12 megapascals at a temperature of 23 degrees Celsius.

14. The image forming apparatus of claim 1, wherein only the farthest downstream one of the plurality of image forming units of the plurality of image forming units includes the lubricant application device.

15. The image forming apparatus of claim 1, wherein the plurality of image forming units, except the farthest downstream one of the plurality of image forming units, do not include any lubricant application devices.

16. An image forming unit, comprising:

an image carrier configured to rotate and carry a latent image;

a charging device configured to charge the image carrier to form the latent image;

a development device configured to develop the latent image into a toner image;

a cleaning device configured to clean the image carrier after the toner image is transferred to an endless intermediate transfer belt of an image forming apparatus; and a lubricant amount detector configured to detect an amount of lubricant present on the intermediate transfer belt based on a frictional force between the endless intermediate transfer belt and a belt cleaning blade, wherein the image forming unit, is positioned as a farthest downstream image forming unit in the image forming apparatus, in the direction of rotation of the endless intermediate transfer belt, and further includes a lubricant application device configured to apply a lubricant to the image carrier.

17. The image forming unit according to claim 16, wherein the lubricant amount detector comprises a torque detection device configured to detect changes in drive torque of the endless intermediate transfer belt.

18. The image forming unit according to claim 16, wherein the lubricant amount detector comprises a deformation amount detection device provided to the belt cleaning blade, the deformation amount detection device being configured to measure changes in elastic deformation of the belt cleaning blade.

19. The image forming unit according to claim 18, wherein the lubricant amount detector is a strain sensor.

20. The image forming unit according to claim 16, wherein the lubricant comprises zinc stearate and boron nitride.

* * * * *